US006328253B1

(12) United States Patent
Paul

(10) Patent No.: US 6,328,253 B1
(45) Date of Patent: Dec. 11, 2001

(54) RECESSED ROLLERLESS HOLDER FOR TOILET PAPER OR THE LIKE

(75) Inventor: Gary Alan Paul, Ossining, NY (US)

(73) Assignee: Paul Decorative Products, Inc., Bronx, NY (US)

( * ) Notice: Subject to any disclaimer, the term of this patent is extended or adjusted under 35 U.S.C. 154(b) by 0 days.

(21) Appl. No.: 09/349,021

(22) Filed: Jul. 7, 1999

(51) Int. Cl.[7] ..... B65H 16/06

(52) U.S. Cl. ..... 242/596.3; 242/596.4; D6/523

(58) Field of Search ..... 242/596.3, 596.7, 242/596.8, 596.4, 597.5; D6/522, 523

(56) References Cited

U.S. PATENT DOCUMENTS

| | | | |
|---|---|---|---|
| D. 307,844 | 5/1990 | Romeka | D6/523 |
| D. 327,193 | 6/1992 | Crook et al. | D6/523 |
| 1,778,282 | 10/1930 | Stewart | 242/596.3 |
| 2,583,411 | 1/1952 | Carlin | 242/55.2 |
| 2,948,486 | 8/1960 | Epeneter | 242/55.55 |
| 4,452,403 | 6/1984 | Arronte | 242/55.2 |
| 4,553,710 | 11/1985 | Pool | 242/55.2 |
| 4,634,067 | 1/1987 | White | 242/55.2 |
| 4,741,486 * | 5/1988 | Ancona et al. | 242/597.5 |
| 5,253,818 | 10/1993 | Craddock | 242/55.2 |
| 5,782,428 | 7/1998 | Chabot | 242/596.8 |

* cited by examiner

*Primary Examiner*—John Q. Nguyen
(74) *Attorney, Agent, or Firm*—Darby & Darby

(57) ABSTRACT

A rollerless device is disclosed for supporting a roll of material, such as toilet paper, within a recess within a wall, for example. The device comprises a shell having a semi-cylindrical cavity for receiving the roll and rotatable pegs mounted at opposite ends of the shell. Each peg includes a hub which is rotatable relative to a base secured to the shell at approximately the midpoint of the shell. Each base and hub includes cooperating members for limiting the movement of the hub from a first position in which the core of the roll is rotatably mounted in the center of the cylindrical cavity, and a second position in which the core can be removed or a new roll inserted into the cavity. The second position is such that when the pegs are not constrained, they will fall under the influence of gravity to the first or roll supporting position.

4 Claims, 2 Drawing Sheets

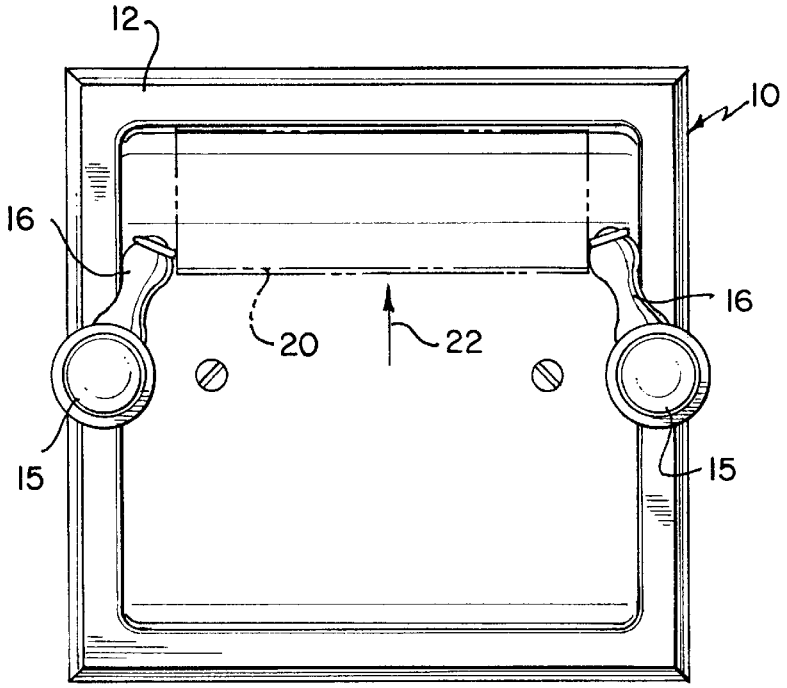
FIG. 3
FIG. 6
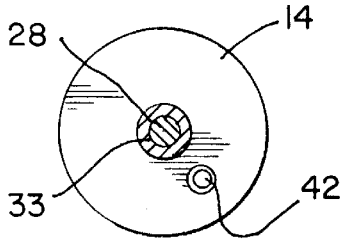
FIG. 4
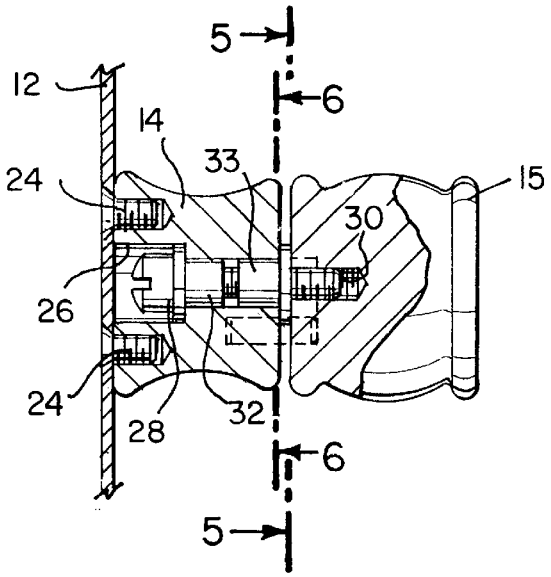
FIG. 5
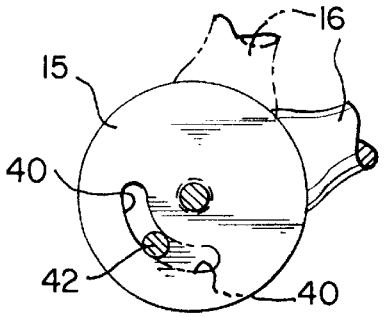

RECESSED ROLLERLESS HOLDER FOR TOILET PAPER OR THE LIKE

This invention relates to a device for supporting a roll of material within a recess. The invention is of particular utility in supporting a roll of toilet paper in a recess within a wall or other mounting surface.

DESCRIPTION OF THE PRIOR ART

Toilet paper holders ordinarily require the insertion of a roller into the core of the paper roll and the subsequent positioning of the roller within any of a variety of mounting arms or the like. Various devices have been proposed to avoid the use of a roller. Representative examples of such devices are shown in Epenetter U.S. Pat. No. 2,948,486 and Chabot U.S. Pat. No. 5,782,428. In those devices, a stub axle or peg is automatically received within the core of the tissue paper when the paper is inserted into the holder. The axle can be pivoted out of the core when the roll is to be removed or inserted. Movement of the axle may be spring loaded or under the influence of gravity. All things being equal, it is generally preferable from a manufacturing point of view to avoid the use of springs.

In most cases, toilet paper holders and, for that matter, comparable holders for any purpose support the roll away from the mounting surface, typically a wall. In some instances, however, particularly where space is at a premium, it may be preferable to position the roll at least partially within the mounting surface. Devices used for these purposes are commonly referred to as recessed holders.

The object of this invention is to provide a rollerless holder for use with a recessed fixture.

More particularly, it is an object of this invention to provide a recessed rollerless toilet paper holder in which no springs are required and which is therefore relatively easy and inexpensive to manufacture.

SUMMARY OF THE INVENTION

A recessed rollerless holder for supporting a roll of material such as toilet paper comprises a shell having a concave cavity adapted to receive the roll and rotatable pegs mounted at each end of the shell for engaging the core on which the material is wound. Each peg is rotatable between a first position in which the core is held substantially at the center of the cavity and a second position in which the core can be removed from the shell, or a new roll inserted. Rotation of the peg is limited to a range defined by these two positions, with the second position being such that when the pegs are not constrained, gravity will cause them to fall to the first or roll supporting position in the center of the cavity.

THE DRAWINGS

FIG. 3 is a front plan view similar to FIG. 2 showing the position of the supporting pegs as the tissue core is being removed;

FIG. 4 is a partial cross sectional view along the line 4—4 of FIG. 2 illustrating one of the supporting mechanisms for the roll;

FIG. 5 is a cross sectional view along the line 5—5 of FIG. 4; and FIG. 6 is a cross sectional view along the lines 6—6 of FIG. 4.

DETAILED DESCRIPTION

Figure 1:
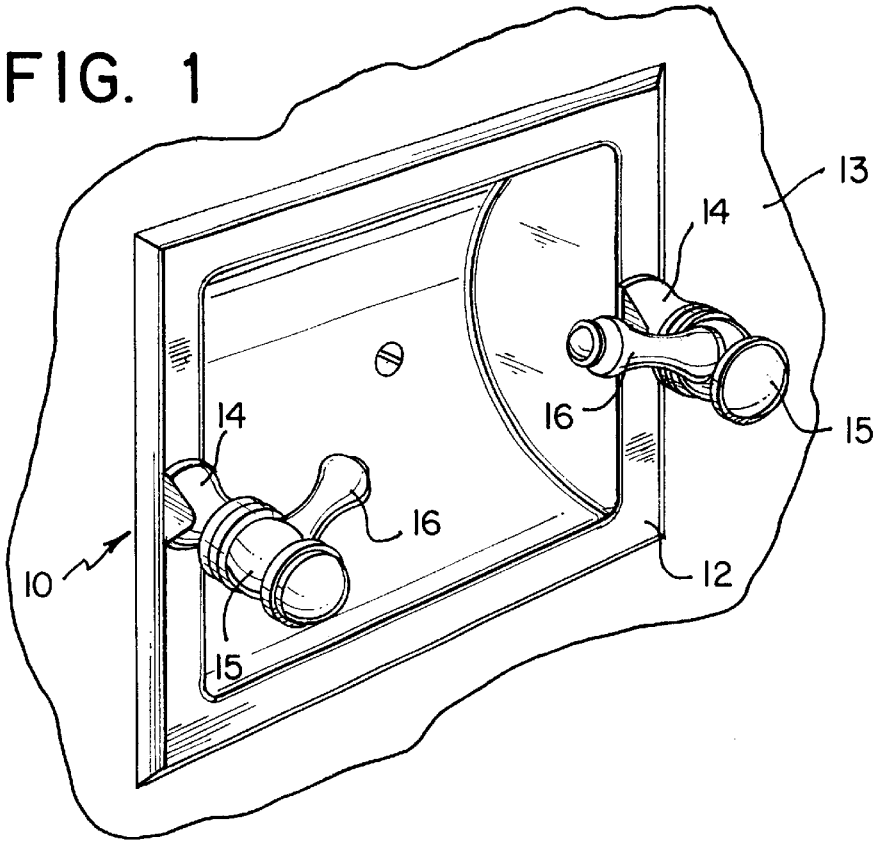
FIG. 1 is a perspective view of a recessed rollerless toilet paper holder in accordance with the invention.

The invention comprises a concave shell 10 which includes a semi-cylindrical cavity 11 and a rectangular peripheral rim 12. As shown in FIG. 1, shell 10 can be recessed into a wall 13 where it is adapted to retain a roll of toilet tissue, half of which will be within the recessed cavity. The support structure for the roll of toilet tissue comprises two identical assemblies mounted at opposite sides of rim 12. Each includes a round base 14 to which a rotatable hub 15 is secured as described below. A stub axle or peg 16 is secured to hub 15, for example by a threaded connection (not shown), so that the pegs can rotate or pivot upwardly from their positions illustrated in FIG. 2.

Figure 2:
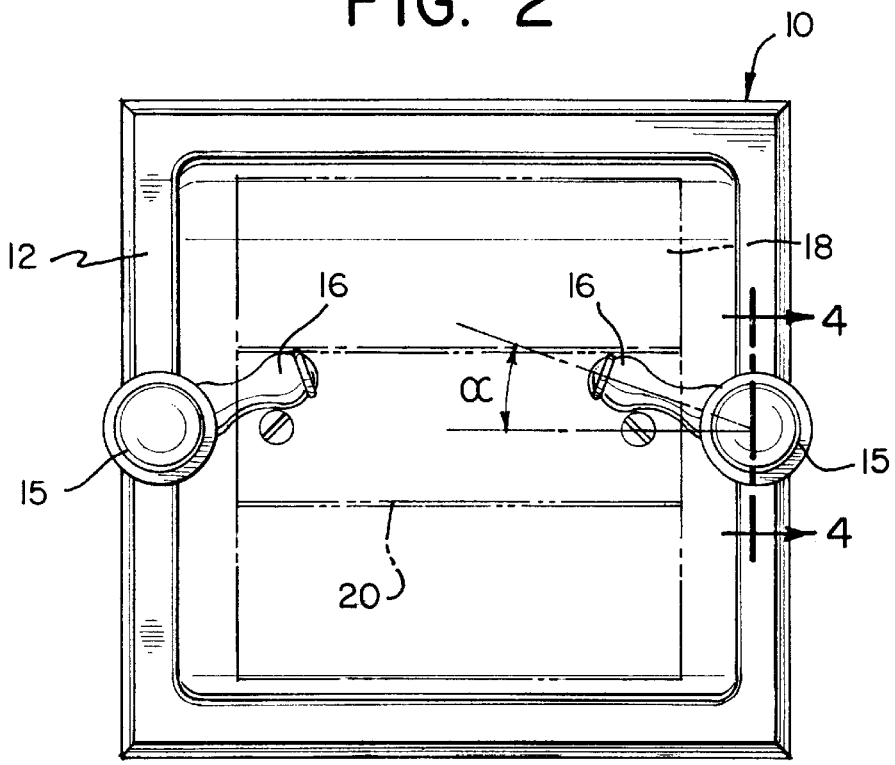
FIG. 2 is a front plan view of the tissue holder of FIG. 1.

As shown in FIG. 2, in use the pegs 16 are positioned at a slight angle relative to horizontal and support a roll of tissue paper 18 by engagement with the conventional core 20 on which the tissue paper is wound.

Because of the fact that the tissue paper is recessed into the wall or other mounting surface, the angle $\alpha$ at which the pegs 16 are offset from horizontal plays an important role. The bases 14 of the mounting assembly are preferably mounted at the mid-point of the vertical portions of the rim 12 so that substantially the entire cavity 11 of shell 10 can be filled with the roll of paper. However, because the pegs 16 (on which the roll of paper is mounted) contact only the upper section of core 20 as shown in FIG. 2, if the pegs 16 were horizontal, the core 20 would not be aligned in the center of the concave cavity 11 of shell 10. Accordingly, by offsetting the pegs 16 slightly with respect to horizontal as shown, the roll of tissue paper 18 can be symmetrically positioned within the cavity of shell 10.

In FIG. 2, the degree of offset is represented by the angle $\alpha$. For a standard roll of toilet paper, the degree of offset will depend on the shape of the peg 16 and the point at which it contacts the core 20. In the illustrated embodiment, the angle $\alpha$ is approximately 22°.

FIG. 3 shows the position of the pegs 16 after the roll of paper has been depleted and the core 20 is being removed. As the core 20 is lifted in the direction of arrow 22, it forces each of the pegs 16 to rotate upwardly so that the ends of the pegs will separate a distance sufficient to enable the core to pass between them so that it can be removed from the shell 10. In a similar fashion, a new roll of tissue paper can be inserted into the shell by using it to apply an upward force to the pegs 16 causing them to separate. When the core 20 is positioned between the pegs, the pegs drop from the position shown in FIG. 3 to the FIG. 2 position under the influence of gravity. Thus, no springs are required and the roll of paper is mounted symmetrically within the concave cavity 11 of the shell 10.

There are many different constructions which can be used to achieve the desired objective as described above, namely, rotatable pegs which, under the influence of gravity, will drop to a position in which they are slightly offset from horizontal. FIGS. 4, 5 and 6 illustrate the details of a commercial embodiment of the invention in which the rotatable pegs 16, hubs 15, and bases 14 have a distinctive and ornamental shape. Obviously, the ornamental aspects of the structural components of the invention form no part of the invention. Since both structures are identical, only one is described.

The base 14 is generally cylindrical and may be secured to the rim 12 by screws 24 which are received within threaded apertures within the bottom of the base and, therefore, not visible when the device is assembled. The base includes a central recess 26 which extends axially through the base. An elongated screw 28 extends through the recess 26 into threaded engagement with a bore 30 in the back of the hub 15. Screw 28 extends through nylon shoulder bushings 32 and 33 which are force fit into opposite ends of the central recess 26 of base 14. Bushings 32 and 33 enable hub 15 with peg 16 to rotate or pivot with respect to base 14, with screw 28 serving as an axle.

A slot 40 is machined into the rear face (left hand side in FIG. 4) of the hub 15 and a stop pin 42 extending from the forward face of the base 14 rides within the slot 40. Engagement of pin 42 with an end of slot 40 limits the upward rotation of the peg 16 (as referenced in FIG. 3) and also defines the offset angle $\alpha$ (FIG. 2). Pin 42 may be retained within a suitable bore (not numbered) in the forward face of base 14.

It is important to limit the upward rotation of the pegs (FIG. 5, shown in phantom) as well as their downward rotation since if the pegs 16 were to rotate too far in the upward direction when the roll of paper is inserted or removed, they might not return to the support position (FIG. 2) under the influence of gravity. The interaction of pin 42 and the other end of slot 40 serves this function.

Obviously, the base 14 and the rotatable hub 15 are assembled before the base is secured to the rim 12 by screws 24.

Although the invention is described for use in supporting a roll of toilet paper, the invention is not so restricted and would have utility in any situation where a roll of material is to be supported in a recessed shell or other container.

What is claimed is:

1. For use in rotatably supporting a roll of material having a core, a rollerless holder, comprising a shell having a concave cavity for receiving the roll, a rod-like peg mounted at each end of the shell for engaging the core, each rod-like peg being rotatable between a first position and a second position, about a pivot point located at the mid-portion of the cavity, each rod-like peg having a free end which engages the upper interior surface of the core to support the roll, the first position being such that the pegs extend at acute angles with respect to horizontal so that the core is supported in the center of the cavity, the second position of the pegs being slightly less than vertical and in which the distance between said free ends of the pegs is sufficient to permit removal of a roll, and means for stopping the movement of said pegs at said first position whereby when they are unconstrained, the pegs will fall under the influence of gravity from said second position to said first position.

2. A rollerless holder according to claim 1, wherein each rotatable peg is supported on a base which is attached to the shell, and wherein said base and peg include cooperating means for limiting the rotation of the peg relative to the base.

3. A rollerless holder according to claim 2, wherein each of said rotatable pegs is fixed to a hub and wherein a fastener extends through said base into engagement with said hub to prevent separation of said base and hub, said fastener being rotatable with respect to said base.

4. A rollerless holder according to claim 3, wherein said cooperating means comprises a slot in one of said base or hub and a stop pin in the other of said base or hub.

* * * * *